United States Patent [19]

Dodge

[11] Patent Number: 4,597,652

[45] Date of Patent: Jul. 1, 1986

[54] PAPER GUIDE WITH WIDTH SENSING AND WIDTH INDICATION SYSTEM

[75] Inventor: Dennis W. Dodge, Amherst, N.H.

[73] Assignee: Itek Corporation, Lexington, Mass.

[21] Appl. No.: 621,413

[22] Filed: Jun. 18, 1984

[51] Int. Cl.[4] ..... B41B 19/00; B65H 9/06

[52] U.S. Cl. ..... 354/7; 354/5; 346/134; 271/255

[58] Field of Search ..... 354/5, 6, 7, 8, 9, 10, 354/11, 12, 13, 14, 15, 16, 17, 18, 19; 346/134, 136; 271/248, 250, 253, 254, 255; 29/129.5

[56] References Cited

U.S. PATENT DOCUMENTS

| | | | |
|---|---|---|---|
| 2,387,954 | 10/1945 | Thompson | 271/255 |
| 2,657,051 | 10/1953 | Waechter | 271/248 |
| 2,696,983 | 12/1954 | Anderson | 271/255 |
| 3,311,371 | 3/1967 | Zeuthen | 271/254 |
| 3,377,008 | 4/1968 | Sutton | 271/255 |
| 3,844,461 | 10/1974 | Robison et al. | 346/136 |
| 4,216,482 | 8/1980 | Mason | 346/134 |
| 4,342,504 | 8/1982 | Ebner | 354/7 |
| 4,473,222 | 9/1985 | Simmons et al. | 271/255 |

*Primary Examiner*—A. A. Mathews
*Attorney, Agent, or Firm*—Homer Blair

[57] ABSTRACT

First and second rotatable edge guide rollers are provided having precision roller positioning means for preventing skewing of sheets of predetermined widths, such rollers being laterally shifted in position to accommodate various widths by means of a roller actuation device which controls a counter which counts the extent of travel of a recording head between a reference position and a position indicative of the guide roller position. The count within the counter is examined by logic circuitry which determines whether the rollers are properly positioned across the width of sheets. The sheet reference platen has a plurality of apertures which receive a fiducial referencing projection mounted upon the roller actuation device and when the actuation device and hence the roller is in one of the predetermined positions the projection device will pass through a particular aperture to permit the sheet referencing platen to be lowered into position. Such projection also produces a visual indication to the operator that the roller is properly positioned with respect to the sheet.

30 Claims, 4 Drawing Figures

PAPER GUIDE WITH WIDTH SENSING AND WIDTH INDICATION SYSTEM

BACKGROUND OF THE INVENTION

The present invention relates to the field of variable widths sheet handling devices.

In phototypesetting equipment it is desirable to accommodate photosensitive sheets having various predetermined widths and to provide edge guide devices to prevent skewing of the sheets as they are fed to the image recordation device. It is desired to provide a pair of edge guide rollers which create reaction forces at the edges of the photosensitive sheets should such skewing commence. It is also highly desirable to provide apparatus for shifting the lateral position of such edge guide rollers to accommodate various predetermined sheet widths, and to provide indications to the operator of improper positioning of such rollers should the operator become careless and improperly positioning them. Besides producing indications of the improper positioning of the edge guide rollers, it is also desirable to provide apparatus for preventing further machine operation in the event of such improper edge guide roller positioning.

SUMMARY OF THE INVENTION

In accordance with a preferred embodiment of the present invention, a sheet edge guide roller is configured to be positively seated within a plurality of predetermined positions across the width of the photosensitive sheets, by being laterally shifted by means of a roller actuation means which presses against surfaces of the roller which are formed by an annular indentation therein. The roller actuation means also carries a switch which is employed to produce an indication of the extent of travel of an image recordation head from a central position to the position occupied by the sheet actuation means. A logic circuit is employed to determine whether the count indicative of the extent of travel of the image recordation head is within predetermined limits to indicate proper positioning of the edge guide roller. If the count is outside of predescribed limits, a logic cirucit produces a halt machine operation indication to alert the operator that the edge guide roller is in an inappropriate position across the widths of the sheet. Additionally should the roller occupy such an inappropriate position, a fiducial projection member mounted upon the sheet guide roller actuation means cannot pass through an aperture formed within the sheet referencing platen, and thus the platen will not be in a position necessary to permit the sheet to be driven through the machine.

Other objects, features and advantages of the present invention will become apparent upon the study of the following specific description, taken in conjunction with the drawings in which.

SPECIFIC DESCRIPTION

Figures 1, 2:
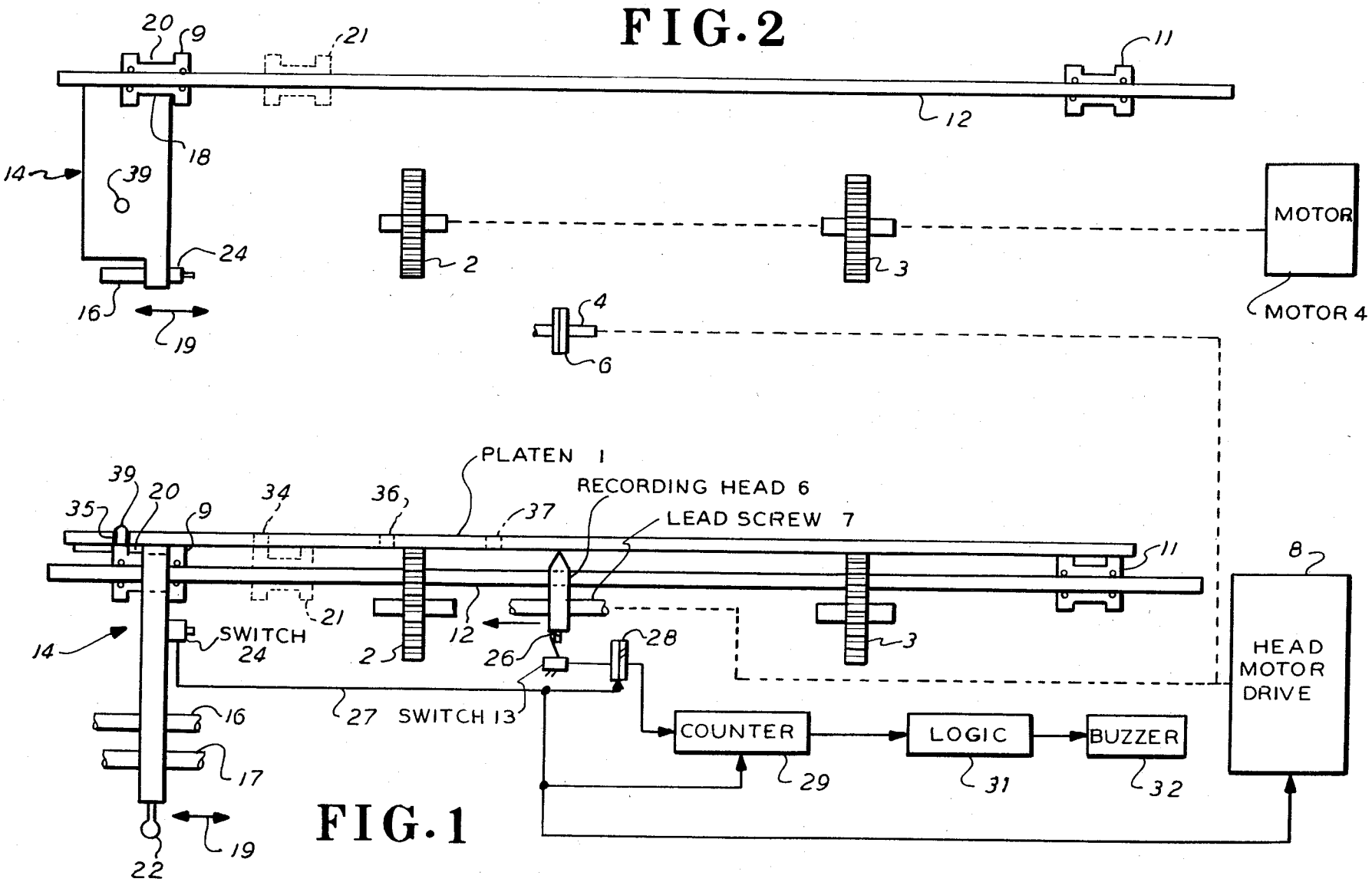
FIG. 1 illustrates a first view of the preferred embodiment.
FIG. 2 illustrates a second view of the preferred embodiment.

Referring now to FIG. 1, a photosensitive sheet referencing device, namely platen 1, is shown together with sheet drive rollers 2 and 3 which serve to press the sheet material against the underside on platen 1 and drive the material. Rollers 2 and 3 are driven by drive roller motor 4 and recording head 6 is driven across the width of the paper by means of a lead screw 7, (a belt, etc.,) which is rotated by head motor drive means 8. The details of recordation head 6 form no part of the present invention, but could include an array of light emitting diodes or fiberoptic filaments; see U.S. Pat. No. 4,342,504. The rotation of lead screw 7 causes the recordation head to sweep across the width of the sheet to record images thereon. An indented paper sheet edge guide roller 9 is positioned at the left hand portion of FIG. 1 to accomodate a sheet having the widest width. In a similar manner, an indented roller 11 is positioned at the right hand portion of the figure. Both rollers 9 and 11 are positively seated upon shaft 12 by guide roller positioning means illustrated in FIG. 3 and to be described hereinafter. Shaft 12 may be supported in bearings so that guide rollers 9 and 11 may be readily rotated. The sheet, driven by rollers 2 and 3 will often have a tendency to become skewed with respect to the drive system, and the inside surfaces of rollers 9 and 11 will at times push against the edges of the sheets to prevent skewing. The "home" position of recordation head 6 is preferably positioned at the center of the sheet drive system, and in this position will be aligned with a position sensing switch 13, as shown in FIG. 1. The switch could be electromechanical or optical. A sheet guide actuation device 14 is provided, which could be supported upon rails 16 and 17 for example, which permit the actuation device to be laterally shifted in order to change the position of the guide roller 9. A projection member 18 is fitted within the annular indentation of edge guide roller 9 as indicated in FIG. 2, so that upon the lateral shifting of the position of actuation device 14 indicated by arrow 19, roller 9 will be unseated with respect to support rod 12 and be displaced to the right to assume, for example, the position indicated by the dotted outline of roller 21. A handle may be provided such as 22 shown in FIG. 1 to facilitate displacement of unit 14.

Figure 4:
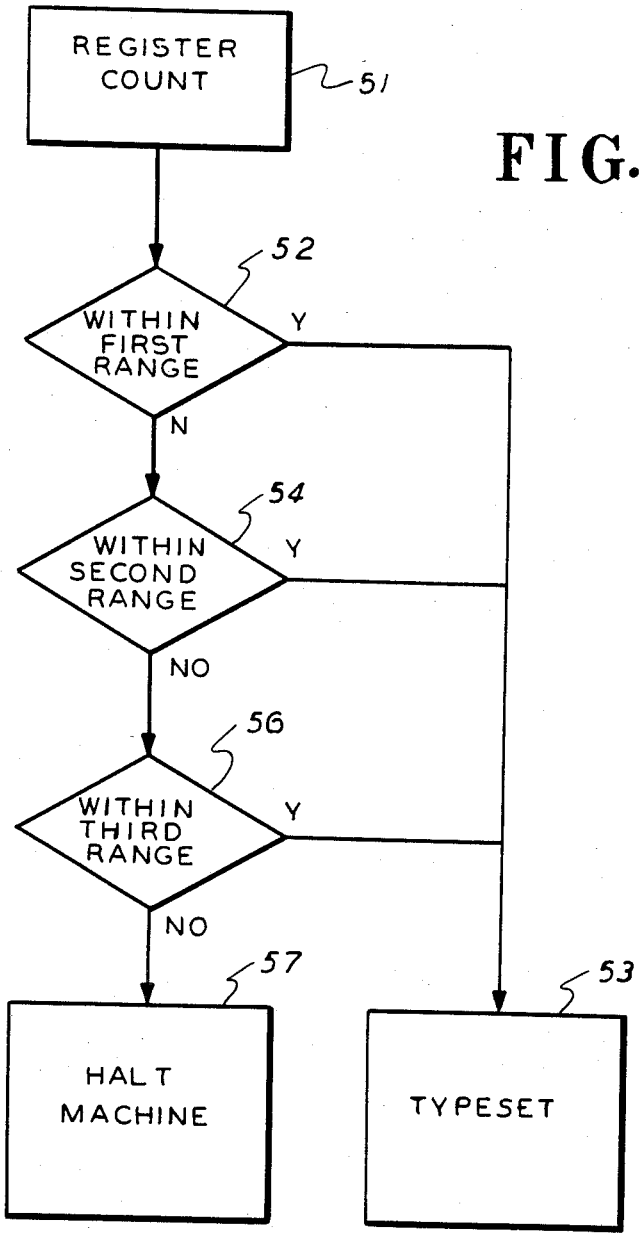
FIG. 4 illustrates a flow chart associated with logic circuit 31.

As mentioned earlier, an object of the invention is to determine whether the edge guide rollers are appropriately positioned to accomodate a particular selected width of sheet. This is carried out by causing the tripping of switch 13 upon the actuation of lead screw 7 by head motor drive 8, which causes recordation head 6 to move toward the left, which continues until a first position sensing device such as limit switch 24 is actuated upon being contacted with projecting member 26, which could be mounted on the recordation head 6. A signal is immediately transmitted over lead 27 which causes the head motor drive 8 to stop driving lead screw 7. The system now determines whether the position of edge guide roller 9 is within proper limits. Upon the displacement of recording head 6 away from the center of the system, switch 13 is actuated to cause the actuation of flip/flop 28, which in turn causes counter 29 to start counting pulses. The actuation of position sensing switch 24 mentioned above, causes the resetting of flip/-flop 28 to stop the timing action of counter 29, and thus counter 29 includes a count which is indicative of the extent of travel of recordation head 6 from its home position at the center of the system, to its final position in the neighborhood of the guide roller actuation device 14, bearing switch 24. The pulses counted by counter 29 could be derived from those pulses applied to the stepping motor within motor drive means 8, or could otherwise be generated by, for example, an incremental encoding disk rotatably coupled to the lead screw 7. Logic circuit 31 examines the final count in counter 29, indicative of the extent of head travel. Details of logic circuit 31 are not disclosed in the interests of brevity and economy but may be readily constructed by the worker in the art after examination of FIG. 4 which illustrates a decision diamond 52, 54, 56 for each predetermined paper width. The ranges will of course exceed the widest manufacturing sheet width tolerance variations. A yes indication from any diamond initiates further machine operation indicated by 53. If the final count registered (block 51) in counter 29 is not within any range, a halt machine operation, indicated by block 57, is produced, e.g. actuation of buzzer 32.

Now let it be assumed that the operator desires to employ a narrower paper sheet. Platen 1 is displaced upwardly from the position shown in FIG. 1, and indented roller 9 is moved laterally by the actuation of handle 22 by the operator, which in turn causes the motion of the sheet guide actuation means 14. The indented roller 9 becomes positively seated at position 21 by the sheet guide positioning means described hereafter in connection with FIG. 3. The roller 9 now occupies the position indicated by 21 in FIGS. 1 and 2, and the referencing platen is lowered into position adjacent the guide rollers and in contact with drive rollers 2 and 3. Assuming the indented guide roller is properly positioned to accommodate the narrower width paper, projection member 39 will be able to pass through aperture 34 to permit the platen 1 to assume the proper lowered position. If the stepped drive roller 9 is improperly positioned, the fiducial projection member 39 will not pass through aperture 34 and the operator will be unable to lower the platen into the proper position, so that the machine will not function properly. Thus projection member 39 coacts with apertures 33, 34, 36 and 37 to establish a fiducial means which also gives a visual indication of the proper positioning of the stepped drive rollers, since the top portion of projection 39, which could be painted white, will be visible to the operator at the upper surface of platen 1 as indicated in FIG. 1. The sheet guide actuation means 14 now assumes a position to the right of that shown, so that the count in counter 29 will have a lower count indicative of the width of the narrower paper now being accomodated by the system.

Thus from the foregoing, it may be seen that a first interlock is provided which produces a halt machine operation indication if the count within counter 9, indicative of the extent of travel of image recordation head 6 is within its predetermined limits proportional to the widths of the various papers transported through the system. The second interlock employs a plurality of aperatures, preferably within sheet referencing platen 1, which receive a projection member 39, which functions as both an interlock and a visual indication to the operator of the proper lateral positioning of edge guide roller 9.

Figure 3:
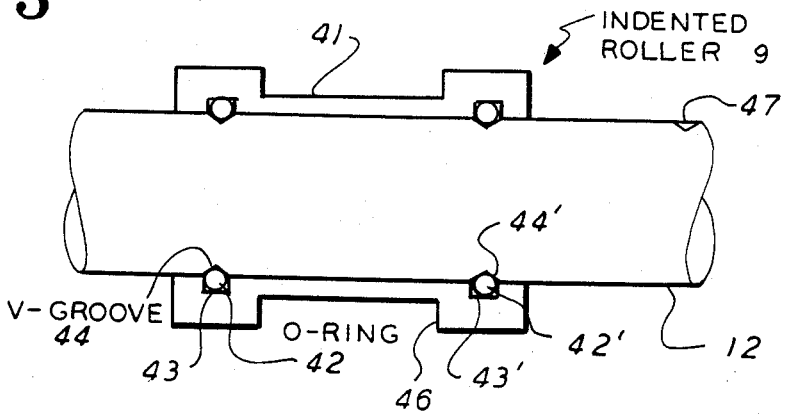
FIG. 3 illustrates a preferred sheet guide roller positioning device.

The edge guide roller positioning means is shown in detail in FIG. 3, which illustrates the indented guide roller 9 having an annular indentation 41 which is employed as mentioned previously to accomodate the guide roller actuation device projection member 18 for causing the roller 9 to be laterally shifted along rotatable shaft 12. An annular O-ring 42, which could be made of rubber or other resilient material, is positioned within an annular roller cavity 43. When roller 9 is properly laterally positioned, O-ring 42 is seated within an annular V groove 44 as indicated in FIG. 3. Roller 9 is laterally moved to the right by the pushing of the actuation projection member 18 against the inner surface 46 of the roller, which causes the O-ring 42 to be pushed out of annular V groove 44 and be carried over to an appropriately positioned V groove, e.g. 47 along shaft 12 wherein it becomes seated within V groove 47 to establish its new lateral position. O-ring 42 is snuggly positioned within annular roller cavity 43 so that it naturally expands into the V grooves to be seated therein. This guide roller positioning means is the subject, of copending patent application No. 628,927, filed July 9, 1984, in the name of Peter Ebner, and is assigned to the same asignee as the present invention.

It should be apparent that other apparatus than that described above may be employed in constructing the present invention, and that the invention is to be limited only by a fair interpretation of the following claim language, and equivalence thereof.

I claim:

1. A variable width sheet guide system for preventing skewing of sheets comprising:

referencing means for referencing major surfaces of said sheets;

first and second sheet guide means for contacting and guiding said sheets driven therebetween;

sheet guide positioning means for selectively positioning at least one of said sheet guide means at a plurality of discreet predetermined positions across the width of said sheet to enable guiding of sheets of variable widths by said first and second guide means;

image recordation means;

sheet guide actuation means coupled to said first guide means for enabling shifting of said first guide means with respect to said referencing means to accomodate sheets of various widths, said sheet guide actuation means having a first position sensing means for sensing the presence of said image recordation means;

second position sensing means for sensing a home position of said image recordation means;

motor drive means for producing relative motion between said image recordation means and said sheets and for stopping said image recordation means upon the sensing of the presence of said image recordation means by said first position sensing means;

travel measuring means coupled to said first and second position sensing means for measuring the extent of travel of said image recordation means between said first and second position sensing means; and logic means for producing a halt machine operation indication if said extent of travel of said image recordation means, measured by said travel measuring means, does not fall within a plurality of limits indicative of acceptable sheet widths.

2. The combination as set forth in claim 1 wherein said sheet guide actuation means and said referencing means have a fiducial means associated therewith, said fiducial means being configured to indicate a first state wherein said first guide means has assumed one of said plurality of discreet predetermined positions, or a second state to the contrary.

3. The combination as set forth in claim 2 wherein said fiducial means prevents the proper positioning of said referencing means adjacent said sheet guide means upon the assumption of said second state.

4. The combination as set forth in claim 3 wherein said fiducial means comprises a plurality of apertures associated with said referencing means and a fiducial projecting member positioned upon said sheet guide actuation means which fits into one of said apertures upon the assumption of said first state.

5. The combination as set forth in claim 4 wherein said fiducial projecting member is configured to extend completely through said one of said apertures upon the assumption of said first state, thereby to produce a visual indication of said first state.

6. The combination as set forth in claims 1, 2, 3, 4 or 5 wherein said travel measuring means includes a counter and said first and second position sensing means each include switches for starting and stopping said counter.

7. The combination as set forth in claims 1, 2, 3, 4 or 5 wherein said sheet guide means includes an indented roller having a circumferential indentation therein and said sheet guide actuation means includes a projection for mating with said indentation to provide lateral displacement of said indented roller by movement of said sheet guide actuation means.

8. A variable width guide system for preventing skewing of sheeets comprising:

platen referencing means for referencing major surfaces of said sheets;

first and second sheet guide rotatable roller means for contacting edges of said sheets and preventing skewing of said sheets driven therebetween;

sheet guide positioning means for selectively positioning at least one of said sheet guide means at a plurality of discreet predetermined positions across the width of said platen to enable guiding of sheets of variable widths by said first and second guide means;

image recordation means;

sheet guide actuation means coupled to said first guide means for enabling shifting of said first guide means with respect to said platen referencing means to accomodate sheets of various widths, said sheet guide actuation means having a first position sensing means for sensing the presence of said image recordation means;

second position sensing means for sensing a home position of said image recordation means;

motor drive means for producing relative motion between said image recordation means and said platen referencing means and for stopping said image recordation means upon the sensing of the presence of said image recordation means by said first position sensing means;

travel measuring means coupled to said first and second position sensing means for measuring the extent of travel of said image recordation means between said first and second position sensing means;

logic means for producing a halt machine operation indication if said extent of travel of said image recordation means, measured by said travel measuring means, does not fall within a plurality of limits indicative of acceptable sheet widths.

9. The combination as set forth in claim 8 wherein said sheet guide actuation means and said referencing means have a fiducial means associated therewith, said fiducial means being configured to indicate a first state wherein said first guide means has assumed one of said plurality of discreet predetermined positions, or a second state to the contrary.

10. The combination as set forth in claim 9 wherein said fiducial means prevents the proper positioning of said referencing means adjacent said sheet guide means upon the assumption of said second state.

11. The combination as set forth in claim 10 wherein said fiducial means comprises a plurality of apertures associated with said referencing means and a fiducial projecting member positioned upon said sheet guide actuation means which fits into one of said apertures upon the assumption of said first state.

12. The combination as set forth in claim 11 wherein said fiducial projecting member is configured to extend completely through said one of said apertures upon the assumption of said first state, thereby to produce a visual indication of said first state.

13. The combination as set forth in claims 8, 9, 10, 11 or 12 wherein said travel measuring means includes a counter and said first and second position sensing means each include switches for starting and stopping said counter.

14. The combination as set forth in claims 8, 9, 10, 11 or 12 wherein said sheet guide means includes an indented roller having a circumferential indentation therein and said sheet guide actuation means includes a projection for mating with said indentation to provide lateral displacement of said indented roller by movement of said sheet guide actuation means.

15. A variable width sheet guide system for preventing skewing of sheets comprising:

referencing means for referencing major surfaces of said sheets;

sheet guide means for contacting and guiding said sheets driven therebetween;

sheet guide positioning means for selectively positioning said sheet guide means at a plurality of discreet predetermined positions across the width of said referencing means to enable guiding of sheets of variable widths by said guide means;

image recordation means;

sheet guide actuation means coupled to said guide means for enabling shifting of said guide means with respect to said referencing means to accomodate sheets of various widths;

fiducial means configured to indicate a first state wherein said guide means has assumed one of said plurality of discreet predetermined positions, or a second state to the contrary, and wherein said fiducial means prevents the proper positioning of said referencing means adjacent said sheet guide means upon the assumption of said second state.

16. The combination as set forth in claim 15 wherein said fiducial means comprises a plurality of apertures associated with said referencing means and a fiducial projecting member positioned upon said sheet guide actuation means which fits into one of said apertures upon the assumption of said first state.

17. The combination as set forth in claim 16 wherein said fiducial projecting member is configured to extend completely through one of said apertures upon the assumption of said first state, thereby to produce a visual indication of said first state.

18. The combination as set forth in claims 15, 16, or 17 wherein said sheet guide means includes an indented roller having a circumferential indentation therein and said sheet guide actuation means include a projection for mating with said indentation to provide lateral displacement of said indented roller by movement of said sheet guide actuation means.

19. A variable width sheet guide system for preventing skewing of sheets comprising:

platen referencing means for referencing major surfaces of said sheets;

sheet guide means including a pair of rotatable rollers for contacting and guiding edges of said sheets driven therebetween;

sheet guide positioning means for selectively positioning one of said rotatable rollers at a plurality of discreet predetermined positions across the width of said referencing means to enable guiding of sheets of variable widths by said rotatable rollers;

image recordation means;

sheet guide actuation means coupled to said guide means for enabling shifting of said guide means with respect to said platen referencing means to accomodate sheets of various widths;

fiducial means configured to indicate a first state wherein said guide means has assumed one of said plurality of discreet predetermined positions, or a second state to the contrary; and wherein said fiducial means prevents the proper positioning of said platen referencing means adjacent said sheet guide means upon the assumption of said second state.

20. The combination as set forth in claim 19 wherein said fiducial means comprises a plurality of apertures associated with said referencing means and a fiducial projecting member positioned upon said sheet guide actuation means which fits into one of said apertures upon the assumption of said first state.

21. The combination as set forth in claim 20 wherein said fiducial projecting member is configured to extend completely through said one of said apertures upon the assumption of said first state, thereby to produce a visual indication of said first state.

22. The combination as set forth in claims 19, 20 or 21 wherein one of said rotatable rollers include a circumferential indentation therein and said sheet guide actuation means include means for mating with said indentation to provide lateral displacement of said roller by movement of said sheet guide actuation means.

23. A variable width sheet guide system for preventing skewing of sheets comprising:

first and second sheet guide means for contacting and guiding said sheets driven therebetween;

sheet guide positioning means for selectively positioning at least one of said sheet guide means at a plurality of discreet predetermined positions across the width of said sheet to enable guiding of sheets of variable widths by said first and second guide means;

image recordation means;

sheet guide actuation means coupled to said first guide means for enabling shifting of said guide means with respect to said referencing means to accomodate sheets of various widths;

motor drive means for driving said image recordation means across said sheets and for stopping said image recordation means at said sheet guide actuation means;

travel measuring means for measuring the extent of travel of said image recordation means across said sheets; and logic means for producing a halt machine operation indication if said extent of travel of said image recordation means, measured by said travel measuring means, does not fall within a plurality of limits indicative of acceptable sheet widths.

24. The combination as set forth in claim 23 wherein said sheet guide actuation means and said referencing means have a fiducial means associated therewith, said fiducial means being configured to indicate a first state wherein said first guide means has assumed one of said plurality of discreet predetermined positions, or a second state to the contrary.

25. The combination as set forth in claim 24 wherein said fiducial means prevents the proper positioning of said referencing means adjacent said sheet guide means upon the assumption of said second state.

26. The combination as set forth in claim 25 wherein said fiducial means comprises a plurality of apertures associated with said referencing means and a fiducial projecting member positioned upon said sheet guide actuation means which fits into one of said apertures upon the assumption of said first state.

27. The combination as set forth in claim 26 wherein said fiducial projecting member is configured to extend completely through said one of said apertures upon the assumption of said first state, thereby to produce a visual indication of said first state.

28. The combination as set forth in claims 23, 24, 25, 26 or 27 wherein said travel measuring means includes a counter and said first and second position sensing means each include switches for starting and stopping said counter.

29. The combination as set forth in claims 23, 24, 25, 26 or 27 wherein said sheet guide means includes a projection for mating with said indentation to provide lateral displacement of said indented roller by movement of said sheet guide actuation means.

30. The combination as set forth in claim 28 wherein said sheet guide means includes a projection for mating with said indentation to provide lateral displacement of said indented roller by movement of said sheet guide actuation means.

* * * * *